United States Patent [19]

Baker

[11] 4,383,583

[45] May 17, 1983

[54] SOIL SAMPLING TOOL

[76] Inventor: Clinton F. Baker, Rte. #4, Fredonia, Kans. 66736

[21] Appl. No.: 346,409

[22] Filed: Feb. 8, 1982

[51] Int. Cl.[3] ..... E21B 7/26

[52] U.S. Cl. ..... 175/20; 73/864.51

[58] Field of Search ..... 175/20, 19, 58, 59, 175/246, 309; 73/864, 864.41, 864.51, 864.64, 864.74; 47/73; 111/4, 7.1, 7.2-7.4, 92, 99

[56] References Cited

U.S. PATENT DOCUMENTS

| | | | |
|---|---|---|---|
| 1,168,486 | 1/1916 | Des Isles | 73/864.51 X |
| 2,544,728 | 3/1951 | Safford | 175/58 |
| 3,065,637 | 10/1962 | Landes | 73/864.64 X |
| 4,252,200 | 2/1981 | Peterson | 73/864.41 X |

FOREIGN PATENT DOCUMENTS

| | | | |
|---|---|---|---|
| 185542 | 8/1966 | U.S.S.R. | 175/58 |

*Primary Examiner*—Stephen J. Novosad

*Assistant Examiner*—Thuy M. Bui

*Attorney, Agent, or Firm*—Robert E. Breidenthal

[57] ABSTRACT

A subsurface soil sampler constituted of a hollow tube having a pointed closure at its lower end for soil penetration and a handle at its upper end for manipulation of the sampler. A combined footrest and penetration limiter is detachably secured at a vertically selected position on the tube enabling application of the user's weight to soil penetration to a selected depth. The tube is provided with a lateral opening adjacent its lower end that is partially bounded by an outwardly offset lip for cutting and diverting a specimen of ambient soil into the tube on movement of the tube such as to advance the free edge of the lip into the soil. Species are disclosed with tangentially and vertically directed lips respectively operative to sample on turning and vertical movement of the tube. A ladle is provided for removing the specimen from the tube. One form of the ladle includes a valve element such that the ladle can be selectively positioned to close and open the lateral opening.

20 Claims, 14 Drawing Figures

FIG. 1
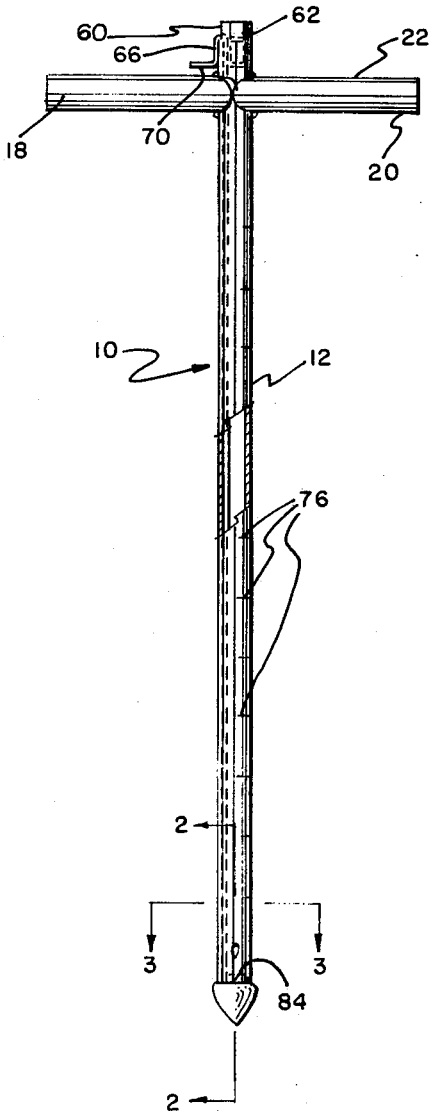
FIG. 3
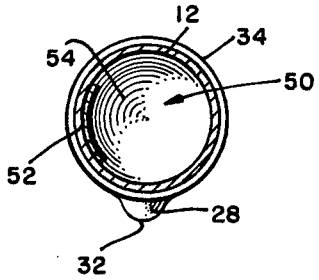
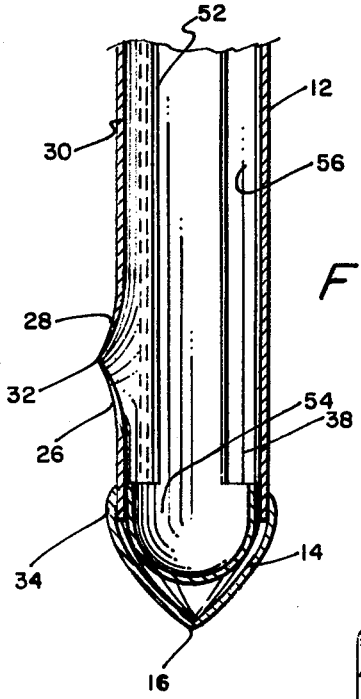
FIG. 2
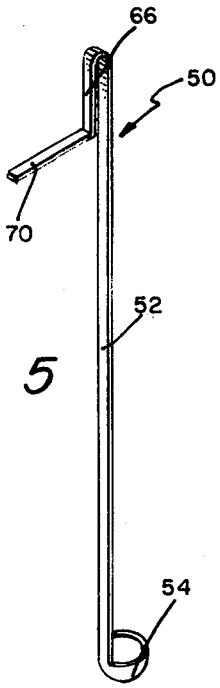
FIG. 5
FIG. 4
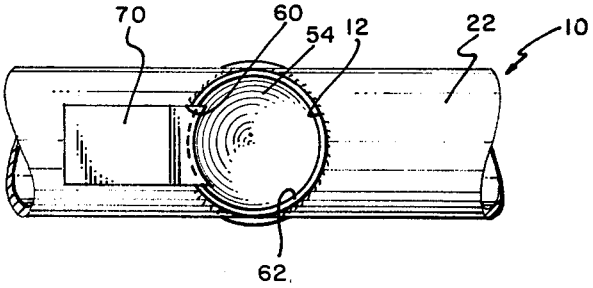

SOIL SAMPLING TOOL

The present invention relates to a soil sampling tool, and more particularly pertains to a tool of such type that is operable to penetrate the ground and to enable withdrawal of subsurface specimens suitable for analysis as to moisture content, fertilizer requirements, mineral deficiencies, physical and chemical properties bearing on permeability, load bearing capabilities, etc., as well as the biological content and the like.

Information such as can be obtained on analysis of properly collected soil samples can be of inestimable value for agricultural purposes in such matters of making crop estimates, determining cost effective irrigation and fertilization programs, estimating planting times, controlling soil infestations, etc. Information can be obtained of value for various engineering purposes, such as road and dam building, estimating drainage requirements, etc.

All the foregoing is well known, however, sample collecting devices heretofore proposed are subject to various deficiencies such as being costly and/or difficult to operate. Very common deficiencies exist such as a collected specimen being difficult to remove from the sampling tube and the specimens collected being much greater in quantity than the actual amount of material needed for the intended analysis. The collection of a much larger bulk of material often imposes the additional operation, prior to analysis, of mixing the bulk of a specimen so that a proper sized and representative portion can be separated for analysis. These deficiencies are especially pronounced when analysis of an average over a continuous range of soil depth is desired.

Another deficiency is that of obtaining a specimen at a particular depth. With some tools such specimen must be separated, on making appropriate secondary measurements, from a bulky continuous sample or core.

Many tools require removal of the entire tool from the ground between each specimen collecting operation.

It is the primary object to provide a sampling tool that will obviate or minimize the deficiencies alluded to above.

An important object of the invention is to provide a sampling tool that can be conveniently and with relative ease be caused to penetrate the ground a selectable depth.

Another important object is to provide a sampling tool which will collect a specimen during effecting a predetermined movement of the tool relative to the ground, which movement may in one form of the tool be a rotational movement, and which movement in another form of the tool can be a vertical movement. A closely related object is to provide such a tool that may be disabled from collecting a specimen while effecting the predetermined movement.

Other objects are to provide a sampling tool which can be assembled so as to vary the overall depth of earth penetration, and which can in a single operation be operated to collect specimens simultaneously from different soil depths.

Yet another important object is to provide a tool such that soil being collected is caused to enter the tool through an opening that is much smaller than the internal dimensions of the tool.

Still other objects of the invention are to provide a sampling tool that is durable, does not contaminate collected specimens, and which is easily cleaned so as to preserve the ease with which it can be caused to penetrate or be withdrawn from the ground.

A final object to be specifically set forth is to provide a soil sampling tool that includes a provision for recovery of a collected specimen from the tool without any need to remove the tool from a ground penetrating position.

A broad aspect of the invention involves a specimen collector comprising an elongated hollow cylindrical tube having a closed lower end adapted to penetrate a mass of material of which a specimen is desired, said tube having a lateral inlet opening adjacent its lower end, said tube being provided with a cutter means adjacent said lateral opening for cutting and directing into the tube through said lateral inlet opening material which may be penetrated by the tube in response to a predetermined movement of the tube relative to such material, and an elongated ladle disposed in the tube comprising a cup fixed to an upstanding shank, said cut having free vertical running clearance in the tube between positions above and below the inlet opening and a configuration such that its periphery has a horizontal projection corresponding substantially to the transverse section of the interior of the tube, whereby the ladle and collected specimen in the cup can be removed from the tube.

The invention, its objectives, features and advantages will be most readily and fully appreciated in the light of the following description of preferred embodiments, such description being given in conjunction with the accompanying drawings illustrative thereof, wherein:

FIG. 1 is an elevational view of the tool with its ladle received therein, with parts being broken away and shown in dashed outline to reveal otherwise hidden details of the structure;

FIG. 2 is an enlarged fragmentary sectional detail view taken upon the plane of the section line 2—2 in FIG. 1;

FIG. 3 is an enlarged horizontal sectional view taken upon the plane of the section line 3—3 in FIG. 1;

FIG. 4 is an enlarged fragmentary top view of the central portion of the tool;

FIG. 5 is an isometric view of the ladle;

Figure 6:
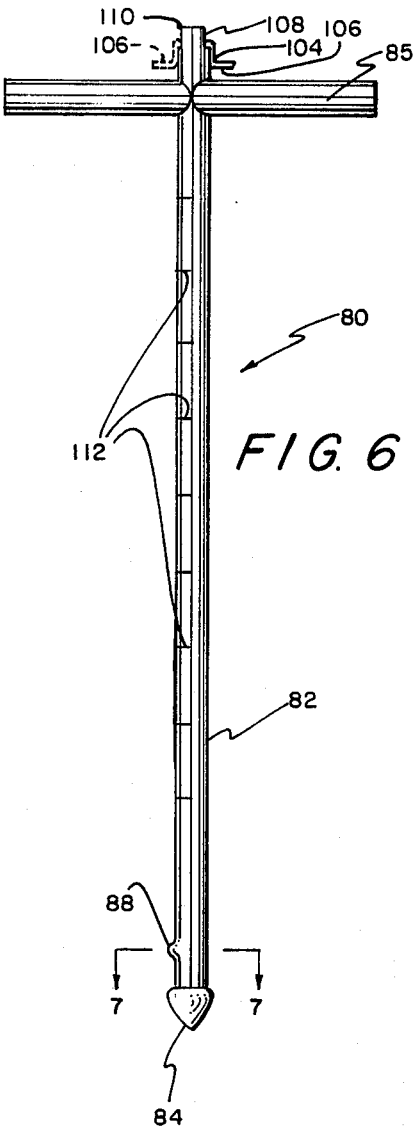
FIG. 6 is an elevational view of a modified form of the tool.

The tool 10 comprises a hollow vertical tube 12 that is closed at its lower end by a steel cap 14 welded or threaded thereto. The cap 14 is of a generally conical configuration as shown so as to provide a pointed lower end 16 for the tube 12.

A pair of diametrically opposed and horizontal steel tubes 18 and 20 are welded to opposite sides of the tube 12 at vertical positions spaced below the open upper end of the tube 12 to constitute a handle 22.

The tube 12, the cap 14 and the handle 22 can be of stainless steel or of any other suitable corrosion resistant material of sufficient strength. However, presently prevailing material costs make it preferable to employ chrome plated iron for such parts, as well as for the ladle structure presently to be described.

The circular cylindrical tube 12 is provided adjacent its lower end with a lateral inlet opening 26, and the portion 28 of the tube wall 30 immediately above the opening 26 is curved radially outwardly and downwardly to constitute an outwardly offset lip 28. The lower free edge portion of the lip 28 is thinned or sharpened to terminate in a downwardly and outwardly directed cutting edge 32. Noting that the cutting edge 32 projects radially outward further from the axis of the tube 12 than the upper edge 34 of the cap 14, the arrangement is such that downward soil penetrating movement of the tube 12 will result in the edge 32 of the lip 28 cutting the soil with the smoothly curved inner surface 56 of the latter diverting such cut or severed soil through the opening 26 and into the hollow interior 38 of the tube 12.

The dimensions of the lip 28 and opening 26 are quite small relative to the internal diameter of the tube 12 for two important reasons. First, the soil entering the tube 12 is not packed into the tube and being loose therein can be easily removed. Second, the quantity of soil collected in the tube 12 for a given vertical movement of the tube 12 is far less than that which would enter the tube 12 if the lower end of the latter were open. Accordingly, a representative specimen of a considerable vertical range of soil depth can be relatively small in quantity.

The radial extent of the cap edge 34 beyond the outer surface 30 of the tube 12 provides at least a degree of clearance for the tube 12 during soil penetration and tends to lessen the downward force required to effect penetration. In this regard the surface 40 is smooth and should be kept free of adhering soil, rust, scales and the like. Use of chrome plated iron or stainless steel is beneficial in this regard.

The tool 10 includes a ladle (see FIG. 5) designated generally at 50 that comprises an elongated vertical shank 52 provided with an integral cup 54. The cup 54 is generally horizontal, opens upwardly and has a circular periphery such as to make a nearly sliding fit in the tube 12 affording free running clearance with the inner surface 56 of the tube 12. The ladle 50 is preferably of chrome plated iron or stainless steel.

The upper end of the tube 12 is provided with a pair of notches 60 and 62 disposed at right angles to each other. The upper end of the ladle shank 52 is formed at its upper end with an inverted U-shaped bend 66 that is engageable over the upper end of the tube 12 and selectively receivable in either the notch 60 or the notch 62 in either of which case the ladle cup 54 is supported at a position spaced below the specimen inlet opening 26. The bend 66 constitutes a ladle support hook which may alternatively be engaged over the upper end of the tube 12 in positions diametrically opposed to the notches 60 and 62 in which event the cup 54 is supported at a relatively higher position.

As best seen in FIG. 3, the ladle shank 52 is of an arcuate configuration that conforms to the inner surface 56 of the tube 12. It will be noted that the shank 52 is seated against the inner surface 56 when the hook at its upper end is engaged over the upper end of the tube. The transverse arcuate extent of the ladle shank 52 is such that the same closes the specimen inlet opening 26 when the ladle hook 66 is engaged over the tube 12 and seated in notch 62. The opening 26 is unobstructed by the shank 52 when the hook 66 is seated in the notch 60 (see FIG. 3), or otherwise out of axmuthal registry with the notch 60. In view of the described arrangement, that portion of the ladle shank 52 that can be selectively placed in and out of positions selectively opening and closing the opening 26 is considered to be a valve element.

The free end of the ladle hook 66 is integrally formed or bent to constitute a handle 70 that is disposed at a height spaced above that of the tube handle 22 when the hook 66 is seated in either of the notches 60 and 62.

It will be evident that when the hook is seated in the notch 62, the valve element of the ladle 50 prevents soil from entering the tube 12 through the opening 26. The opening 26 will remain closed until the handle 70 is lifted from its seated position in the notch 62. The opening 26 will be open in any event unless the hook 66 has been at least partially lowered within the notch 62. Lowering the hook 66 into the notch 60 virtually precludes inadvertent placement of the hook 66 in notch 62.

The tube 12 may optionally be provided with indicia 76 along its length whereby the depth of penetration of the tool 10 into the ground may be gauged.

As the tool 10 is forced vertically into the ground by use of the handle 22, the lip 28 cuts soil and diverts severed soil into the tube 12 provided the hook 66 is not seated in notch 62. If the hook 66 is seated in notch 60, the diverted soil or specimen falls into the ladle cup 54. Penetration can be interrupted at any selected ground depth determined by use of the indicia 76, and the ladle 50 withdrawn so that soil thus far collected in the cup 54 can be recovered and placed in specimen receptacles (not shown) that may, if desired, have been prelabeled.

It will be evident that the hook 66 can be engaged in notch 62 during penetration of vertical depths or ranges of depths that are not to be sampled.

For reasons explained previously, the total quantity of specimen representing a sampling of a substantial vertical range may be quite small in amount. If a larger specimen is desired, the tool 10 can be repetitiously moved vertically in the same ground hole made by the tube 12 with the tool 10 being turned a bit before each downward movement an amount sufficient to assure the lip 28 a virgin travel or cutting path.

As explained above, specimens can be recovered from the tool 10 without raising the tube 12 by use of the ladle. Clearly, if so desired as is expected to be the usual case, the ladle 50 can be removed to recover a specimen after the tube 12 has been withdrawn from the ground.

As will become evident, the tool 10 can be used in conjunction with a combined footrest and penetration limiter to be subsequently described in connection with another modification of the invention yet to be discussed, whereby the weight of the user can be more easily applied to effect ground penetration.

Figure 7:
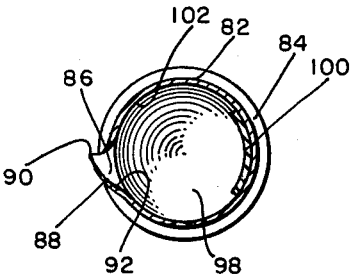
FIG. 7 is an enlarged horizontal sectional view taken upon the plane of the section line 7—7 in FIG. 6.

Attention is now directed to another modification of the tool which is designated generally at 80 and shown in FIGS. 6 and 7. The tool 80 comprises a hollow steel tube 82 having a pointed closure cap 84 fixed to its lower end. The tube 80 is provided adjacent its upper end with a handle 85. At a position spaced above its lower end, the tube 82 is provided with a lateral specimen inlet opening 86 that is partially bounded by a radially outward and circumferentially extending tube portion 88 constituting an offset lip that terminates in a sharp cutting edge that faces in a horizontal direction substantially tangential to the vertical axis of the tube 82. The opening 86 and structure adjacent thereto is quite analogous to the opening 26 and structure adjacent thereto in the previously described embodiment of the invention shown in FIGS. 1–5, with the difference that in the tool 80 the lip 88 and its cutting edge 90 cut soil and diverts it into the tube 82 along the smooth arcuate inner surface 92 of the lip in response to the tube 82 being turned about its vertical axis in a clockwise direction as viewed in FIG. 7.

The tool 80 includes a ladle corresponding to the previously described ladle 50, the same comprising (see FIG. 7) a cup 98 fixed at the lower end of a shank 100 of arcuate cross section that seats against the inner surface of the tube 82. The upper end of the shank 100 is provided with a hook 104 and a handle 106. The hook 104 is selectively engaged on the tube 82 in diametrically opposed notches 108 and 110. When engaged in the notch 108 as shown in full lines in FIG. 6, the shank 100 is out of position to close the opening 86 and the cup 98 is spaced below such opening 86. When the hook is engaged on the tube 82 and seated in the notch 110 as shown in dashed outline in FIG. 6, the shank 100 serves as a valve element and closes the opening 86.

Figure 8:
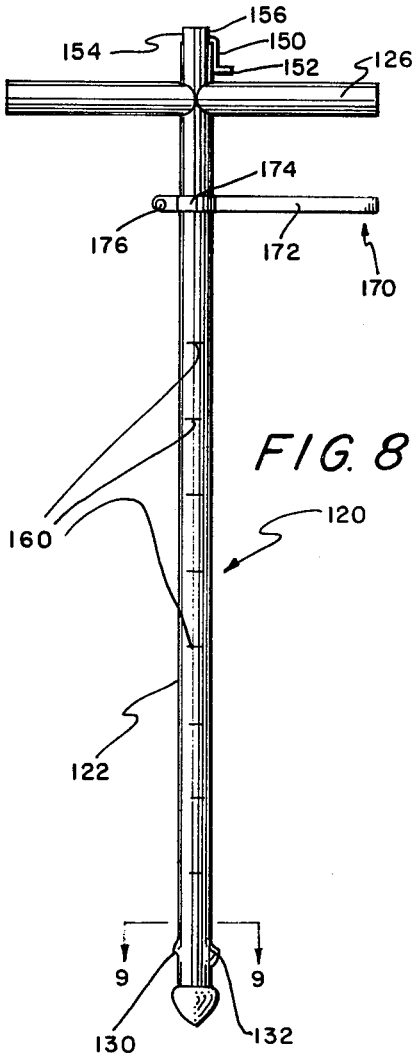
FIG. 8 is an elevational view of yet another modification of the tool.
Figure 9:
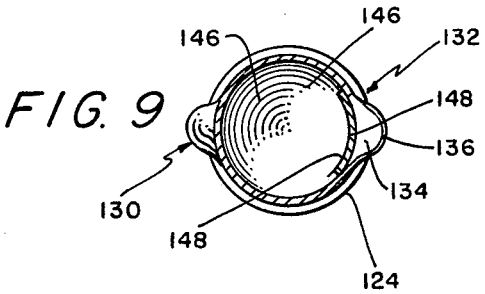
FIG. 9 is an enlarged horizontal sectional view taken upon the plane of the section line 9—9 in FIG. 8.
Figure 10:
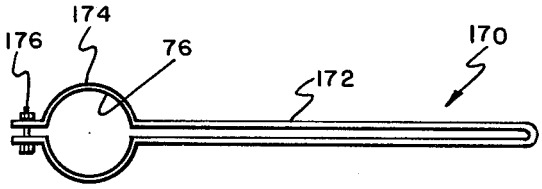
FIG. 10 is an enlarged top plan view of the combined footrest and penetration limiter shown in FIG. 8.

The tube 82 is provided with suitable depth or penetration indicia 122 and the tool 80, as well as the tool 10, can be provided with the combined footrest and adjustable depth limiter to be described in conjunction with the form of the invention shown in FIGS. 8, 9 and 10.

The use of the tool 80 is quite analogous to that of the tool 10. Suffice to say, a specimen can be collected at a particular level and recovered by use of the ladle without removing the tool from the ground, and the vertical position of the tube 82 then adjusted to collect and recover a specimen from another depth of interest. As in the use of the tool 10, the valve function of the ladle can be utilized to preclude entry of soil into the tube 82.

Attention is now directed to the tool modification shown in FIGS. 8, 9 and 10, such modified tool being designated generally at 120. The tool 120 comprises a tube 122 closed at its lower end by a pointed closure cap 124, with a handle 126 being attached to the tube 122 adjacent its upper end.

Adjacent its lower end, the tube 122 is provided with a specimen cutting and inlet means 130 that is identical to the corresponding means included in the previously described tool 10, namely, the opening 26, offset lip 28 and cutting edge 32. The means 130 serves to cut and divert soil into the tube 122 in response to downward movement of the tool 120. Diametrically opposed to the means 130, the tube 122 is provided with means 132 identical to the means 130 except for being inverted whereby soil is cut and diverted into the tube 122 in response to upward movement of the tool 120. The means 132, as shown in FIG. 9, includes a lateral inlet opening 134 partially bounded on its lower side by an offset lip having an upwardly directed cutting edge 136.

The tool 120 includes a ladle similar to the ladle 50 comprising a cup 146, and an arcuate shank 148 provided with a hook 150 and handle 152 at its upper end. The hook 150 is engageable over the upper end of the tube 122 and selectively seated in diametrically opposed notches 154 and 156. When the hook 150 is seated in either of the notches 154 and 156, the cup 146 is spaced below the means 130 and 132. Selectively seating the hook 150 in the notches respectively closes the means 130 and 132, while respectively opening the means 132 and 130. Accordingly, the positioning of the ladle enables selective closure of the means 130 and 132. With either upward or downward movement of the tool 120, such of the means 130 or 132 then functionally operative to sever and divert soil into the tube 122 may if desired for any reason be selectively disabled.

The use of the tool 120 is generally similar to that of the tool 10 except greater flexibility is realizable in that sampling can be effected with raising the tool 120 as well as when it is being lowered.

Indicia 160 on the tube 122 enables the user to gauge the depth of penetration. Such indicia can also be employed in positioning a combined footrest and penetration limiting means 170 on the tube 122. The means 170 comprises a horizontally extending footrest 172 provided at one end with an integral split ring clamp 174 that slidably embraces the tube 122 so as to enable its complete removal from the other parts of the tool 120 if desired as well as its being vertically adjustable along the tube 122. The split ring clamp 174 includes a threaded bolt and nut means 176 that may be tightened to releasably secure the means in adjusted position on the tube 122.

As mentioned previously, the means 170 can also be included in the tools 10 and 80, the function of the same being the same in any case. The means 170 enables the user to apply his weight (by placing his foot on the footrest 172) to aid in ground penetration by the tool. Furthermore, the means 170 serves to limit ground penetration on engagement with the ground surface.

The means 170 serves yet another function should the withdrawal of the tool from the ground become difficult. In such use the same is placed at a position just sufficiently above the ground surface to enable a rod or lever (not shown) to be placed thereunder whereby the same can conveniently be pried out of the ground, with the means 170 being lowered as necessary as the raising process progresses.

Attention is now directed to still another modification of the invention, such modified tool is designated generally at 200 and is depicted in FIGS. 11 through 14.

The tool 200 comprises a tube made up of a plurality of tubular sections 204, 206, 208 and 210. The uppermost tubular section 204 has a handle 212 fixed thereto at a position spaced below its upper end. The upper end of the tubular section 204 is provided with a pair of notches 214 and 216 that are disposed at right angles to each other relative to the axis of the tubular section.

The tubular sections 204–210 are circular in section and of equal diameters. The upper end portion 220 of the tubular section 206 is of reduced diameter and is threaded for threaded connection into the internally threaded lower end portion 222 of the upper tubular section 204. The threaded connection of the portions 220 and 222 of the tube sections 206 and 204 is such that the cylindrical external and internal surfaces 224 and 226 mate as smooth continuations of each other.

The upper end portions of the tubular sections 208 and 210 are reduced and threaded as indicated at 228 and 230 identically to the portion 220 so that, if desired, either of the tubular sections 208 or 210 could be selectively threaded to the tubular section 204. In an analogous fashion, the lower end portions of the sections 206, 208 and 210 are internally threaded at 232, 234 and 236 identically to the internally threaded portion 222. Manifestly, the arrangement is such that any of the male portions 220, 228 and 230 can be threadingly coupled in a releasable manner to any one of the female portions 222, 232 and 234.

A closure cap 240 having a bluntly pointed lower end 242 and a radially reduced and externally threaded upper end 244 is provided. The threaded end 244 is such as to make selective and releasable threaded connection to any of the female portions 222, 232, 234 and 236.

The tool 200 is provided with a ladle 250 that comprises a shank 252 of arcuate section having a hook 254 at its upper end that terminates in a laterally extending handle or finger grip 256.

Figure 11:
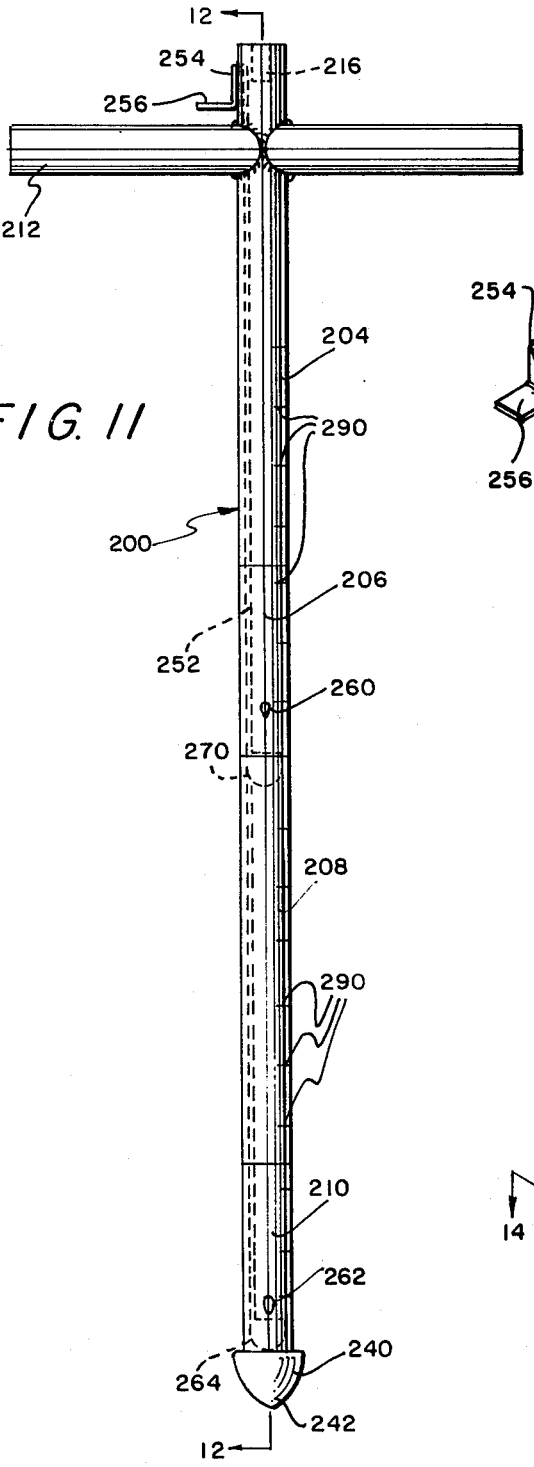
FIG. 11 is a side elevational view of yet another modification of the tool with the concealed portions of the ladle being shown in dashed outline, and with an alternative position of the upper end of the ladle being shown in dashed outline.
Figure 13:
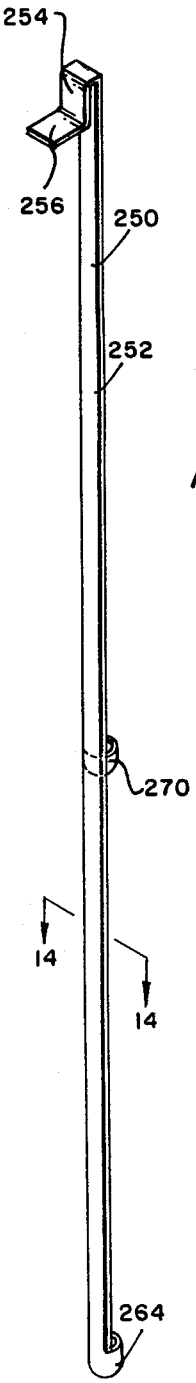
FIG. 13 is an isometric view of the ladle forming a part of the tool shown in FIG. 11; and, FIG. 14 is an enlarged vertical sectional view of the ladle taken upon the plane of the section line 14—14 in FIG. 13.
Figure 12:
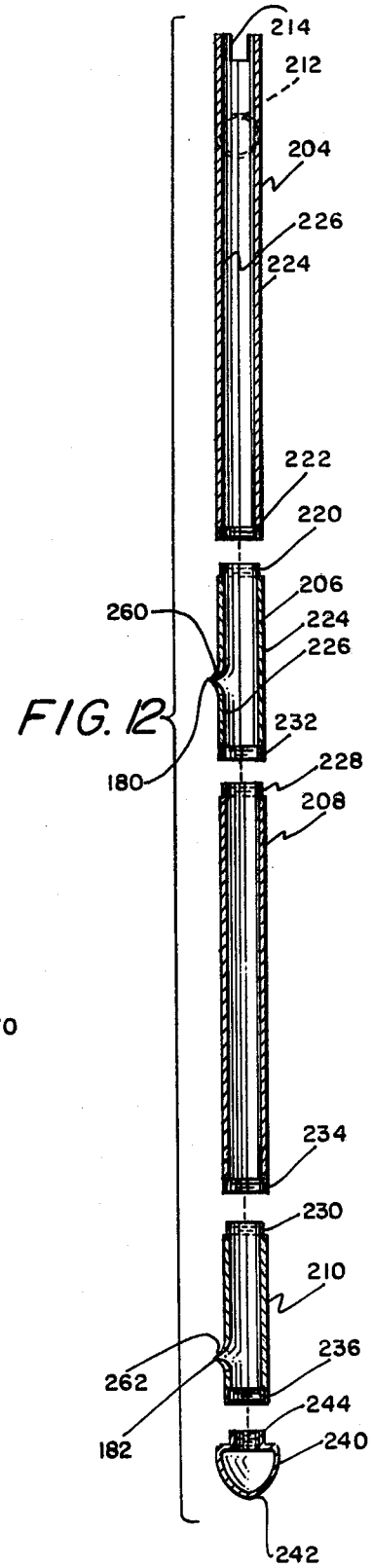
FIG. 12 is an exploded view of the tool shown in FIG. 11 with the ladle removed, the view being a central sectional view taken upon the plane of the section line 12—12 in FIG. 11.
Figure 14:
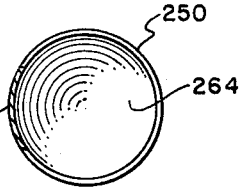

With the tubular sections 204–210 and the closure cap 240 assembled as shown in FIG. 11, and with the tubular sections 206 and 210 being provided with specimen cutting means 260 and 262 respectively, the ladle 250 is of a length such that a cap 264 fixed to its lower end is disposed below the specimen cutting means 262 when the hook 264 is engaged in either of the notches 214 and 216. It will be noted that the arcuate shank does not obstruct either of the specimen cutting means 260 and 262 when the hook 254 is engaged in the notch 214, but closes both when engaged in the notch 216. The shank 252 has a second cup 270 integrally fixed thereto that bears the same relation to the specimen cutting means 260 as the cup 264 bears to the specimen cutting means 262.

While specimen cutting means 260 and 262 are identical to each other and to the specimen cutting means of tool 10 and described relative to the reference numerals 26, 28 and 32 so as to include downwardly directed lip cutting edges 180 and 182, it will be understood that the specimen cutting means 260 and 262 can differ from each other as well as differ from the means shown in FIG. 2. Either of the means 260 and 262 can, if desired, have upwardly rather than downwardly directed cutting lips (such as shown in FIG. 8). Alternatively, either of the means 260 or 262 may include a tangentially directed cutting lip such as shown in FIG. 7 that would cut when the tool 200 is turned in a direction such as to tighten the threaded couplings. It will be understood that the tool 200 would be provided with an assortment of tubular sections such as the sections 206 and 210 differing from each other by the types of specimen cutting means with which they are provided. Indeed a user might also be provided with an assortment of different ladles differing in length and/or the number of or spacing of its cups to be appropriate to any of a plurality of ways in which a user might couple a plurality of tubular sections, as will be evident to those skilled in the art.

The tool 200 has depth or length indicia 290 on the tubular sections thereof as shown in FIG. 11, and it will be understood that the tool 200 can be provided with an adjustable footrest and penetration limiter such as previously described in connection with reference numeral 170.

The tool 200 can be made of any suitable material, metal or nonmetal; however, it is believed the stainless steel or chrome-plated iron are best with the latter being especially preferred because of lower cost. It will be appreciated that a chrome plating of sufficient thickness is very hard, durable and resistent to corrosion, all to the effect that the tool 200 will not contaminate specimens and can be kept clean easily, while having a superlative appearance.

The use of the tool 200 will be manifest in view of the previous descriptions of the use of the other forms of the tool, and further explanation is unnecessary and would be superfluous.

Having fully described the invention, attention is now directed to the appended claims for an appreciation of the actual scope of the invention.

I claim:

1. A specimen collector comprising an elongated hollow cylindrical tube having a closed lower end adapted to penetrate a mass of material of which a specimen is desired, said tube having a lateral inlet opening adjacent its lower end, said tube being provided with a cutter means adjacent said lateral opening for cutting and directing into the tube through said lateral inlet opening material which may be penetrated by the tube in response to a predetermined movement of the tube relative to such material, and an elongated ladle disposed in the tube comprising a cup fixed to an upstanding shank, said cup having free vertical running clearance in the tube between positions above and below the inlet opening and a configuration such that its periphery has a horizontal projection corresponding substantially to the transverse section of the interior of the tube, whereby the ladle and collected specimen in the cup can be removed from the tube.

2. The combination of claim 1, wherein the cutter means comprises a cutter lip offset outwardly from the transverse outer periphery of the tube, said lip being fixed to the tube and in part bounding a side of the inlet opening, with said lip having a specimen cutting edge facing away from the side of the inlet opening bounded by the lip.

3. The combination of claim 2, wherein the side of the inlet opening bounded by the lip is at the bottom of such opening, whereby the predetermined relative movement of the tube is upwardly.

4. The combination of claim 2, wherein the side of the inlet opening bounded by the lip is at the top of such opening, whereby the predetermined relative movement of the tube is downwardly.

5. The combination of claim 2, wherein the cutting edge faces a direction tangential to the vertical extent of the tube, whereby the predetermined relative movement of the tube is rotational about a vertical axis.

6. The combination of claim 2, wherein the tube is provided with a second lateral inlet opening that is correspondingly provided with a second cutter lip, with the first mentioned inlet opening being bounded at its top by the first mentioned lip, and with the second inlet opening being bounded at its bottom by the second cutter lip.

7. The combination of claim 6, wherein the ladle is rotatable about its longitudinal vertical axis within the tube, and valve means carried by the ladle for selectively closing one of the inlet openings in response to the ladle being moved to a particular vertical and azmuthal orientation relative to the tube.

8. The combination of claim 2, with handle means fixed to the tube for manipulating the latter.

9. The combination of claim 1, wherein the ladle is rotatable about its longitudinal vertical axis within the tube, and valve means carried by the ladle for selectively closing the inlet opening in response to the ladle being moved to a particular vertical and azmuthal orientation relative to the tube.

10. The combination of claim 7, with means for releasably retaining the ladle in a predetermined spatial relationship to the tube.

11. The combination of claim 10, wherein said spatial relationship corresponds to said particular orientation.

12. The combination of claim 10, wherein said spatial relationship is displaced from said particular orientation.

13. The combination of claim 1, with means carried by the shank that coacts with the tube for limiting downward movement of the ladle within the tube.

14. The combination of claim 1, together with limiting means mounted on the tube adapted for limiting the penetration into a mass of material.

15. The combination of claim 14, wherein said means is detachably mounted in a vertically selectable position on the tube.

16. The combination of claim 14, wherein said limiting means constitutes a footrest whereby the weight of a user may be applied to facilitate penetration.

17. The combination of claim 1, wherein said lateral opening and the cutter means adjacent thereto constitute a first specimen cutter means, and said tube being provided with a second specimen cutter means spaced above the first specimen cutter means, and a second cup fixed to the ladle shank a vertical interval above the first mentioned cup corresponding to the vertical spacing of the first and second specimen cutting means.

18. The combination of claim 17, wherein the tube includes a plurality of sections that are releasably and threadingly connected to each other.

19. The combination of claim 18, wherein different sections of the tube are provided with the first and second specimen cutting means.

20. The combination of claim 1, wherein the tube includes a plurality of sections that are releasably and threadingly connected to each other.

* * * * *